US005435089A

United States Patent [19]

Rodney, Jr.

[11] Patent Number: 5,435,089

[45] Date of Patent: Jul. 25, 1995

[54] MUZZLE LOADER BARREL HAVING A COUNTER BORE TO FACILITATE LOADING OF A SLUG

[76] Inventor: Frederick W. Rodney, Jr., 134 Flagg Rd., Gonic, N.H. 03839

[21] Appl. No.: 60,164

[22] Filed: May 7, 1993

[51] Int. Cl.[6] ..... F41A 21/18

[52] U.S. Cl. ..... 42/51; 89/1.3; 89/14.3; 42/78; 42/90

[58] Field of Search ..... 42/51, 78, 105, 90; 89/1.3, 14.3, 14.6, 14.05

[56] References Cited

U.S. PATENT DOCUMENTS

| | | | |
|---|---|---|---|
| 315,746 | 4/1885 | De Arguibel | 42/78 |
| 2,699,094 | 1/1955 | Musser | 89/14.05 |
| 3,225,655 | 12/1965 | Inglis | 89/14.05 |
| 3,788,188 | 1/1974 | Donner | 42/78 |
| 4,715,139 | 12/1987 | Rodney Jr. | 42/51 |
| 4,918,849 | 4/1990 | Spota | 42/51 |

FOREIGN PATENT DOCUMENTS

| | | | |
|---|---|---|---|
| 2520859 | 8/1983 | France | 42/78 |
| 299148 | 12/1919 | Germany | 89/1.3 |
| 237415 | 8/1945 | Switzerland | 89/14.3 |
| 14806 | 12/1885 | United Kingdom | 42/78 |

*Primary Examiner*—Stephen M. Johnson
*Attorney, Agent, or Firm*—Davis, Bujold & Streck

[57] ABSTRACT

A rifled muzzle loader barrel having a cylindrical counterbored muzzle end with the counterbore having a diameter substantially equal to an outer diameter defined by the rifling and substantially equal to an outer diameter of a slug of the desired calibre for that barrel and also being of a length sufficient to facilitate proper alignment of an appropriate calibre slug as it is inserted into the muzzle end of the barrel. The invention also relates to a slug loading tool for facilitating loading the muzzle loader and gas exhaust holes for creating a force opposing a recoil force of the barrel upon being discharged.

19 Claims, 5 Drawing Sheets

MUZZLE LOADER BARREL HAVING A COUNTER BORE TO FACILITATE LOADING OF A SLUG

The present invention relates to an improvement concerning muzzle loaders for facilitating precise loading of a bullet or slug within the barrel thereby to increase the velocity and accuracy of the slug as it is discharged out of the barrel.

BACKGROUND OF THE INVENTION

One of the difficulties associated with the known muzzle loading fire arms is the difficulty of precisely loading the slug in the barrel so that the longitudinal axis of the slug substantially coincides with the longitudinal axis of the barrel. If the slug has been precisely loaded into the barrel, a much tighter and uniform perimeter seal can be achieved between the exterior surface of the slug and the mating interior rifled surface of the barrel. The better the seal between the two surfaces, the greater of the velocity of the slug will be upon being fired from the barrel. In addition, greater accuracy will also be achieved as the rifling of the barrel will provide the slug with a truer rotational spin and minimize tumbling of the slug once it is fired from the muzzle end of the barrel.

The closest know prior art relating to the present invention is believe to be Applicant's own U.S. patent (U.S. Pat. No. 4,715,139 issued on Dec. 9, 1987) which teaches generally a counterbore located in the muzzle end of the barrel for accommodating a muzzle loading tool. In this citation, however, the disclosed counterbore has a diameter much greater then the outer diameter of the rifling or the diameter of the slug and does not function to accurately align a slug as it is loaded into the muzzle end of the barrel.

Wherefore, it is an object of the present invention to provide an arrangement which facilitates quick, consistent, precise and easy loading of a slug into the muzzle of a barrel.

A further object of the invention is to ensure that the central longitudinal axis of the slug, once loaded, substantially coincides with the central longitudinal axis of the barrel so that a complete peripheral seal between the exterior surface of the slug and the interior rifled surface of the barrel is achieved to prevent any of the gases, generated upon the explosion of the gun powder, from escaping or leaking past the seal formed therebetween.

A still further object of the invention is to facilitate easy modification of existing muzzle loaders so that the teaching of the present invention may be incorporated therein.

Another objection of the invention is to facilitate engagement between a muzzle loading tool and the muzzle end of the barrel so that the slug, gun powder, and/or wad can be loaded into the central bore of the barrel in a quick continuous motion.

Still another object of the invention is to provide a plurality of holes in the muzzle end of the barrel to minimize recoil of the barrel as it is discharged.

These and other objects of the present invention will be further understood by those skilled in the art by having reference to the following description and accompanying drawings.

SUMMARY OF THE INVENTION

A rifled muzzle loader barrel having a cylindrical counterbored muzzle end, the counterbore having a diameter substantially equal to an outer diameter defined by the rifling and also substantially equal to an outer diameter of a slug of a desired calibre for that barrel and being of a length sufficient to facilitate proper alignment of an appropriate calibre slug as it is inserted into the muzzle end of the barrel.

A method of adapting a muzzle end of a rifled muzzle loader barrel to assist with loading of a slug therein, said method comprising the step of providing a cylindrical counterbore, in the muzzle end of the barrel, having a diameter substantially equal to an outer diameter defined by the rifling and of a length sufficient to facilitate proper alignment of an appropriate calibre slug as it is inserted into the muzzle end of the barrel.

BRIEF DESCRIPTION OF THE DRAWINGS

Preferred embodiments of the present invention will now be described, by way of example, with reference to the accompanying drawings, in which.

DETAILED DESCRIPTION OF THE INVENTION

Figure 1:
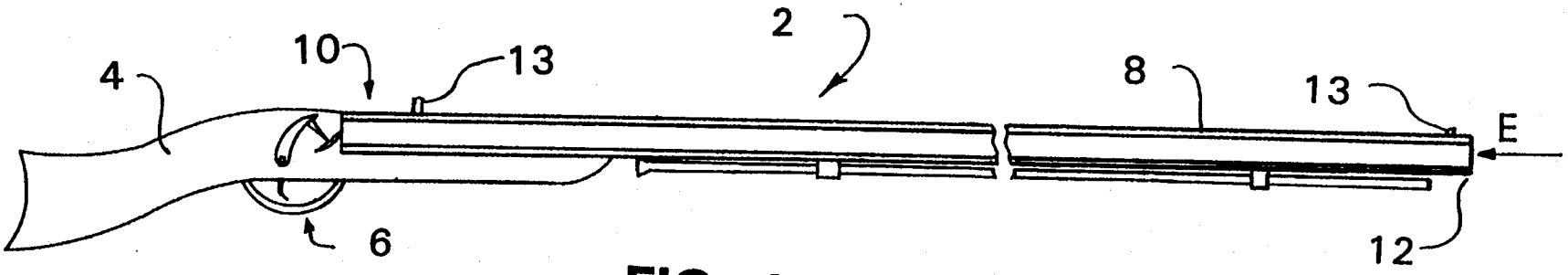
FIG. 1 is a diagrammatic representation showing generally the elements of the muzzle loader fire arm of the present invention.

As can be seen in FIG. 1, the muzzle loader fire arm is generally depicted by reference numeral 2 and comprises stock member(s) 4, a trigger mechanism 6, including hammer means and a percussion cap, and front and rear sights 13 for assisting a user with the proper alignment of the gun barrel with the desired target. As such components are conventional and well known in this art, they will not be discussed in detail hereinafter. The muzzle loader fire arm further comprises an elongate barrel 8 having a closed breech end 10 located adjacent the trigger mechanism 6 and an opened muzzle end 12 located remote from the trigger mechanism for allowing discharge of the slug at a desired target.

Figure 2:
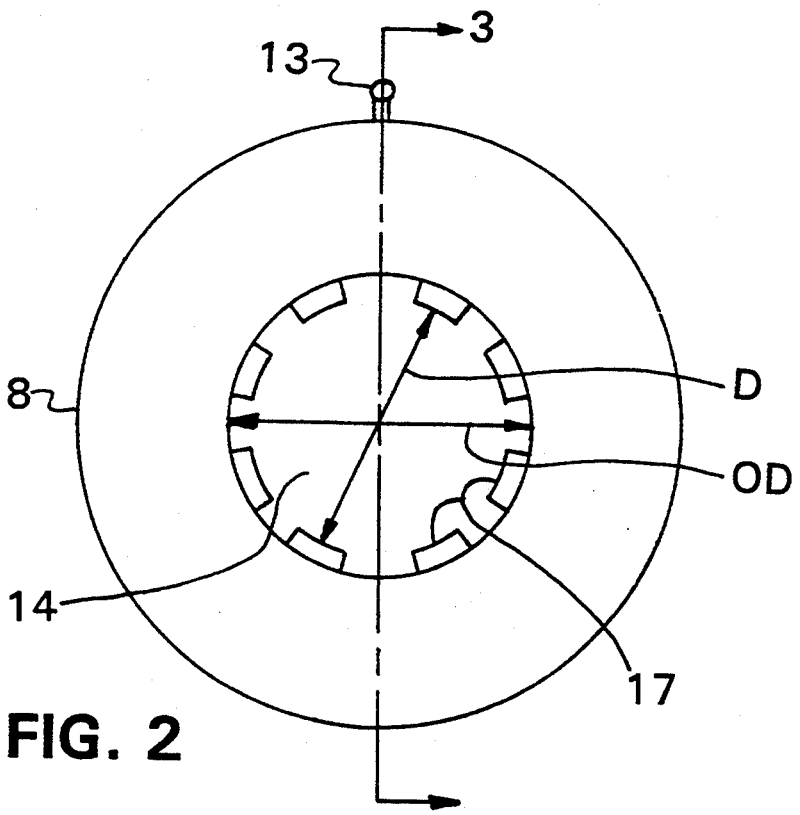
FIG. 2 is a diagrammatic end view of the fire arm of FIG. 1 in the direction of arrow E.
Figure 3:
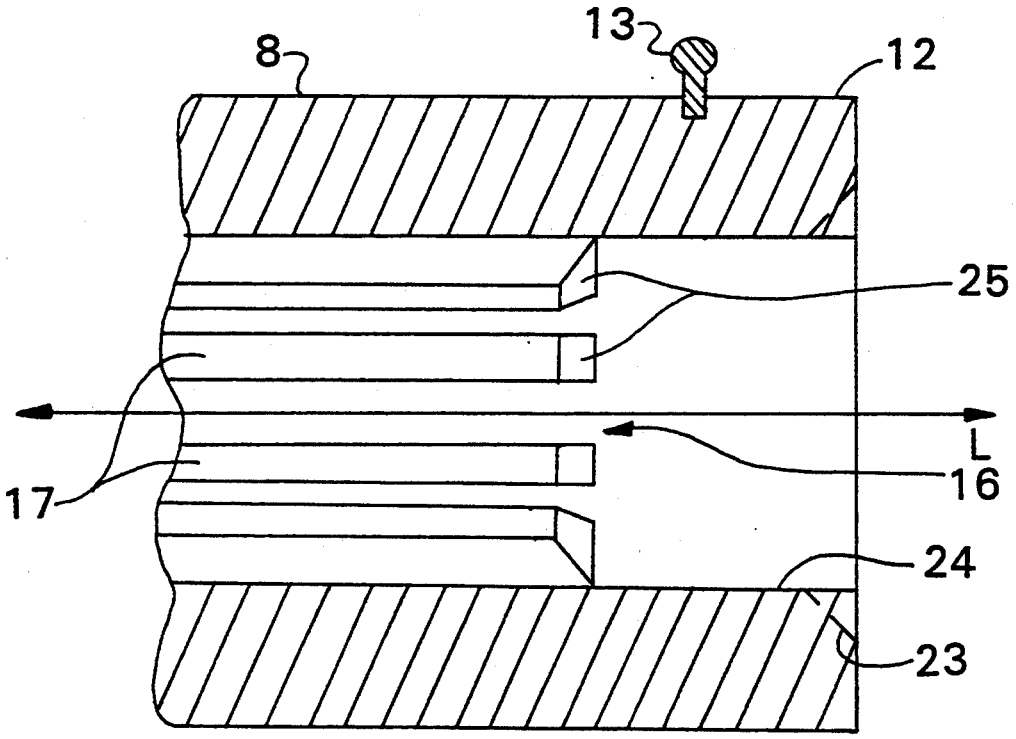
FIG. 3 is a fragmentary cross-sectional elevation of the muzzle end of the barrel along section line 3—3 of FIG. 2.

Turning now to FIGS. 2 and 3, a first embodiment of the present invention will now be described in detail. The barrel 8 is provided with a central bore 14 which extends substantially along the entire length of the barrel 8 from adjacent the breech end 10 to the muzzle end 12. A helical rifling 16 of a desired pitch, depth, etc., and is formed on the inner surface of the central bore 14 to import a desired spin to the slug 18 as it is discharged from the barrel 8. The rifling 16 can be formed by swaging or any other well known suitable processes. The diameter D of the central bore 14 is typically 0.010's of an inch less than an outer diameter OD defined by the rifling, e.g. each rib of 17 of the rifling 16 is typically approximately 0.005's of an inch high. In a 50 calibre fire arm, for example, the central bore would typically have a diameter D of 0.490's of an inch and the outer diameter OD defined by the rifling 16 would typically have a diameter of 0.500's of an inch, that is, the same diameter as the slug to be fire by that calibre fire arm. A chamfer 23, shown in ghost, may be formed at the entrance of the central bore to facilitate insertion of a slug or a loading tool into the muzzle end of the barrel.

Figure 4:
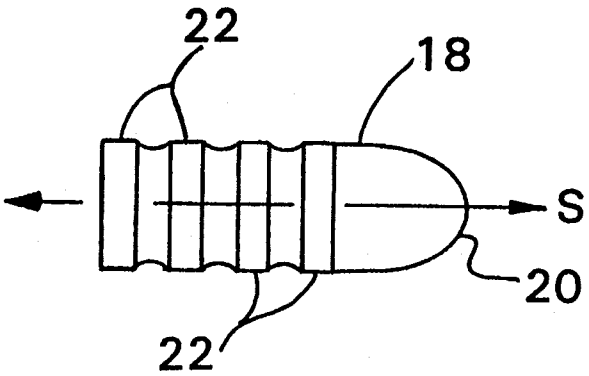
FIG. 4 is a side elevation of a conventional slug suitable for being loaded and discharged out of the barrel of the present invention.

As can be seen in FIG. 4, a typical slug 18 comprises a forward impact point 20 and a cylindrical surface 22. It is to be appreciated that the surface 22 can be one continuous surface or may comprise a plurality of sequentially arranged, spaced circumferential bands, four being shown in FIG. 4. The purpose of the surface or surfaces 22 is to engage the rifling 16 contained within the barrel and form a tight seal therewith and thereafter provide the slug 18 with a desired spin as it is discharged out the muzzle end of the barrel. The rate of spin of the slug 18, upon being discharged, will depend upon the pitch of the rifling and the velocity of the slug as is well known in the art and thus not discussed further in any detail.

The novel feature of the present invention relates to the formation of a first cylindrical counterbore 24 extending inwardly from the muzzle end of the barrel 8. The counterbore 24 has a diameter which is substantially equal to the diameter of the slug (calibre) to be discharged and is thus also substantially equal to the outer diameter OD defined by the rifling 16 of the barrel. The length of the counterbore 24 is substantially equal to the overall length of the surface 22 of a slug 18 of that calibre and typically will have a length from about 0.25 inches to about 1.75 inches for a 0.50 calibre slug. As the first counterbore 24 has a diameter substantially equal to the diameter of the slug and bore length substantially equal to the length of the surface(s) 22 of the slug 18, the first counterbore 24 substantially aligns the central longitudinal axis S of the slug 18 with the central longitudinal axis L of the barrel and facilitates a complete, substantially uniform tight peripheral seal between the slug 18 and the rifling 16 of the barrel thereby preventing gases, generated by the burning of the black powder, upon firing the fire arm, from leaking past the slug 18. Since the slug is typically manufactured of lead, it is easily deformable upon being forced into the rifling of the barrel and will be rotated, by the rifling 16, as the slug 18 is moved from the muzzle end 12 to the breech end 10 of the barrel 8. To assist with insertion of the slug 18 into the rifling portion of the barrel, the rifling immediately adjacent and abutting the first counterbore 24 has a chamfered 25 or is provided with some other gradual transition therebetween. The deformation is such that the slug entirely fills the bore 14 and the associated rifling grooves to provide a complete seal therebetween.

Figure 5:
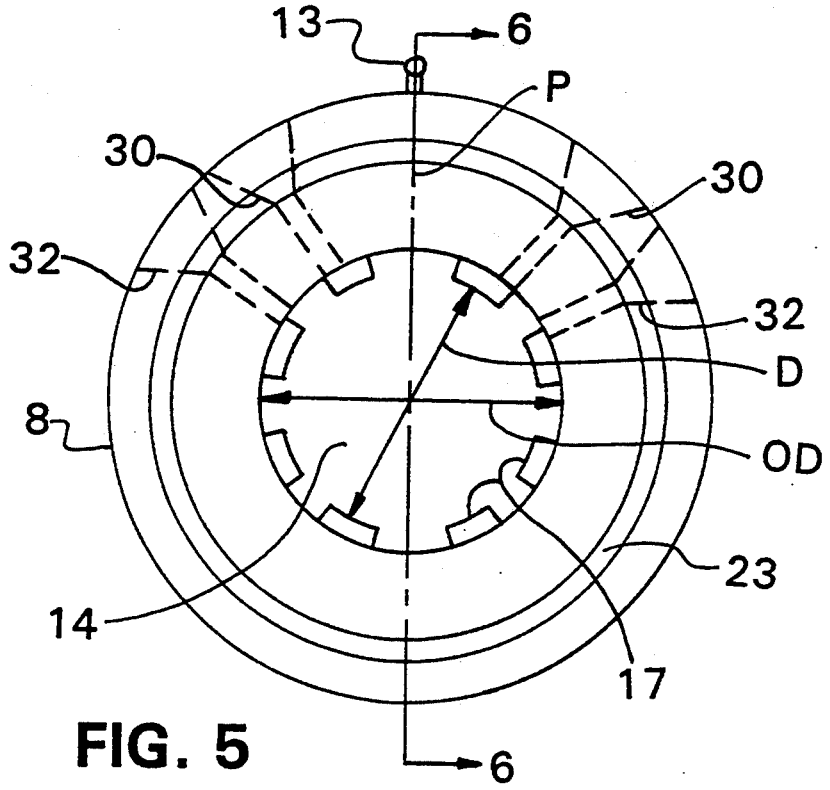
FIG. 5 is a diagrammatic end view of the fire arm of FIG. 1, in the direction of arrow E, showing a second embodiment of the present invention.
Figure 6:
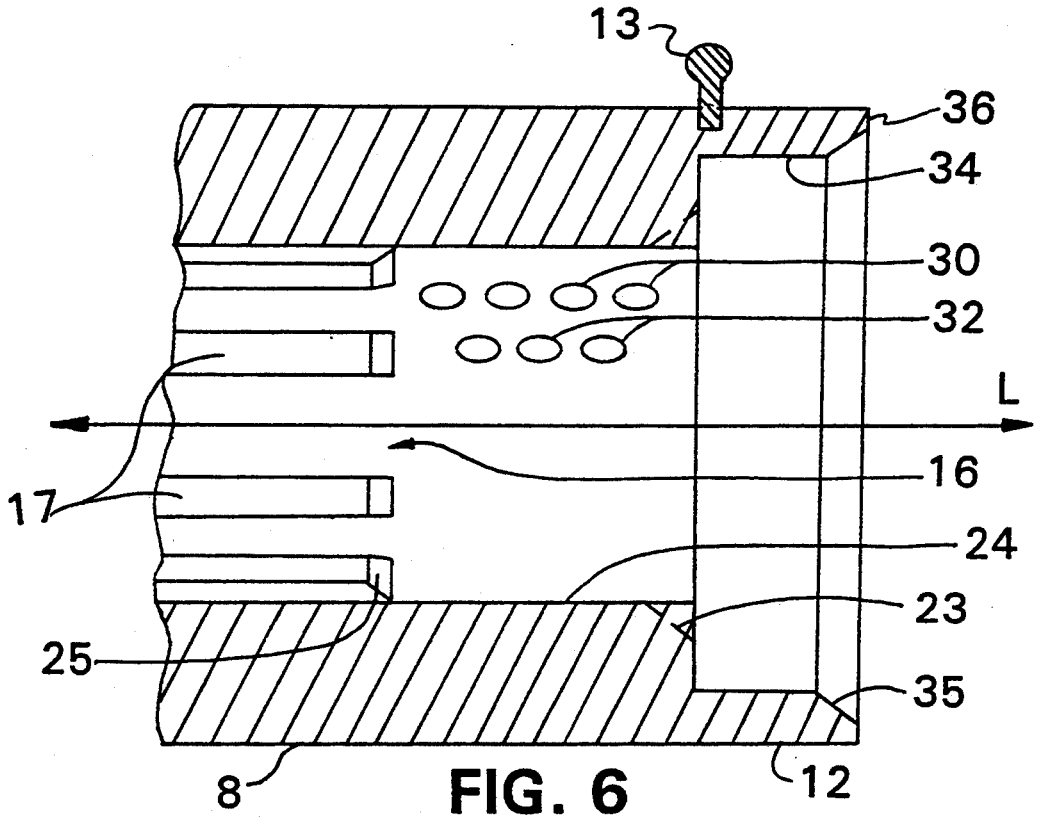
FIG. 6 is a partial cross-sectional view of the muzzle end of the barrel along section line 6—6 of FIG. 5.

Turning now to FIGS. 5 and 6, a second embodiment of the present invention can be seen and will be discussed in detail. This embodiment is substantially similar to the first embodiment except that the length of the counterbore 24 has been increased and the muzzle end 12 of the barrel 8 in order to accommodate a plurality of openings (fourteen) 30, 32 extending completely through the wall of the barrel 8 with the axis of each hole being substantially perpendicular to the longitudinal axis L of the barrel 8. Four equally spaced sequentially arranged holes 30, each having a diameter of approximately 0.0625 to 0.250 inches, are provided at 30° on either sides of a central plane P defined by the longitudinal axis L of the barrel and three equally spaced sequentially arranged holes 32, each having a diameter of approximately 0.0625 to 0.250 inches, are provided at 60° on either sides of the central plane P defined by the longitudinal axis L of the barrel. The three holes 32 are located intermediate the four holes 30 axially of the bore axis L. The purpose of the holes 30, 32 is to allow the gases, produced during discharge of the firearm, to be exhausted from of the barrel as the slug 18 leaves the barrel. The gases which exit through those holes 30, 32 force the muzzle end of the barrel downward, i.e. create a force opposing a recoil force imposed on the barrel, and compensate the natural tendency of the barrel 8 to "kick" upwardly (recoil) as it is discharged.

A second cylindrical counterbore 34 is provided in the muzzle end 12 between a muzzle end face 36 of the barrel and the counterbore 24. The second cylindrical counterbore 34 is dimensioned so as to receive snugly a slug loading tool 100, which will be discussed further in detail hereinafter. A second chamfer 35 is provided between the end face 36 of the muzzle end and the second cylindrical counterbore 34 to facilitate insertion of the loading tool within the muzzle end 12 of the barrel.

Figure 7:
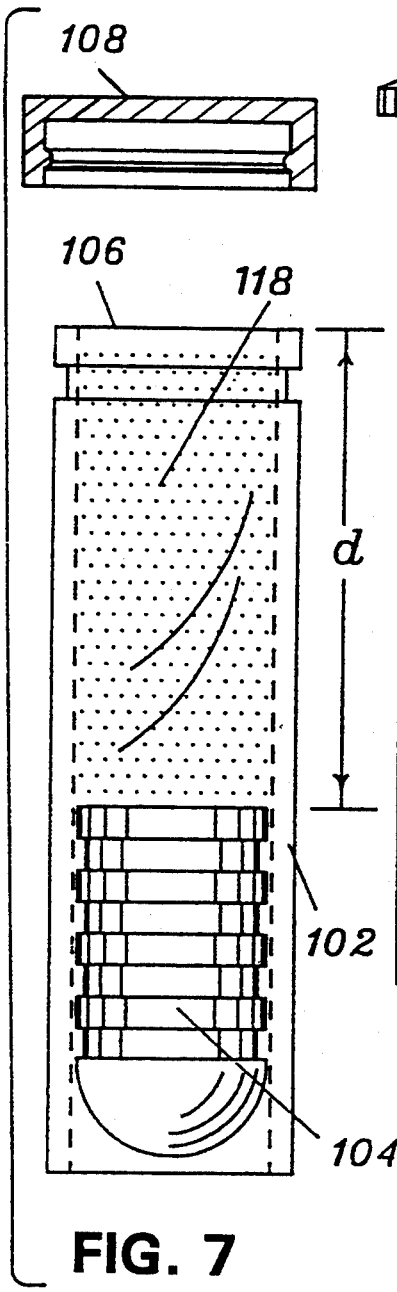
FIG. 7 is a diagrammatic side view of the body portion of the muzzle loader tool of the present invention showing how a slug and powder charge are contained therein.
Figure 8:
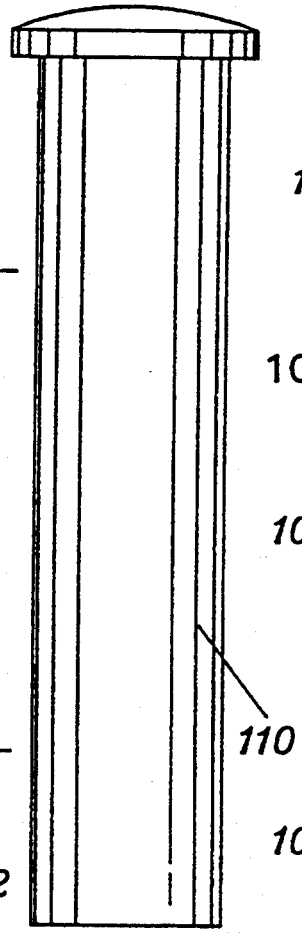
FIG. 8 is a side elevational view of a plunger portion of the muzzle loader tool of the present invention.
Figure 9:
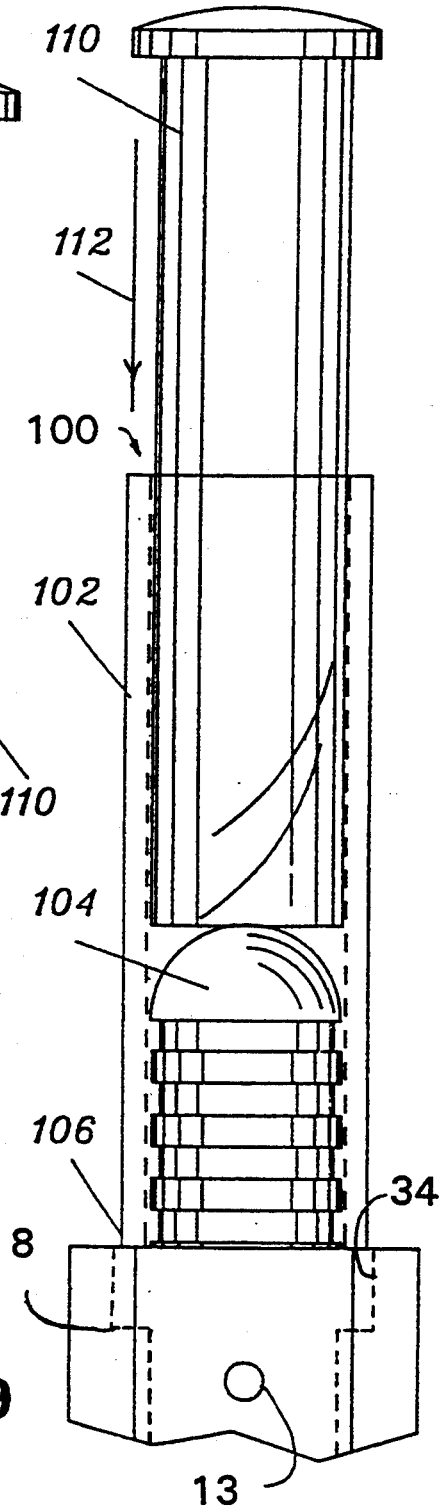
FIG. 9 is a diagrammatic side view of the assembled muzzle loader tool of the present invention in the process of injecting its powder charge and slug into the barrel of a muzzle loader.

Turning now to FIGS. 7 through 9, the muzzle loading tool 100 to be used in combination with the foregoing barrel to accomplish one of the stated objects of the present invention will now be described. The body portion 102 thereof is shown inverted in FIG. 7; that is, the bottom end is up as the figure is viewed. Body portion 102 is cylindrical in shape and open at both ends. It is made of a resiliently deformable plastic such as polyethylene and has an outside diameter sized to snugly slide into the second counterbore 34 of the barrel 8. The inside diameter of the loading tool 100 is sized to snugly accept a slug or bullet 104 therein. The distance "d" between the bottom of a bullet 104 disposed therein and the bottom end 106 is selected so that a pre-established and desired measure of gun powder 118 will be contained therein. If desired, a snap-on plastic cap 108 can be provided therefor so that a number of preloaded charges can be conveniently carried by a user. To load the muzzle loader with the tool 100, the cap 108 is removed, if present, and bottom end 106 is inserted into the second counterbore 34 of the barrel 8 as shown in FIG. 9 and the cylindrical plastic plunger member 110 of FIG. 8, having an outside diameter adapted to slide within the body portion 102, is used to push the bullet 104 and the charge of gun powder 118 into the barrel 8 in the direction of arrow 112, following which a ramrod is used, in a conventional manner, to ram the charge home and insert the wadding.

Since certain changes maybe made in the above described muzzle loader barrel without departing from the spirit and scope of the invention herein involved, it is intended that all subject matter contained in the above description and shown in the accompanying drawings shall be interpreted as being illustrative of the inventive concept herein involved shall not be construed as limiting the invention.

I claim:

1. A muzzle loader barrel having a breech end and a muzzle end;

said muzzle loader barrel being rifled, said muzzle end of said rifled muzzle loader barrel having a first counterbore therein spaced from a muzzle end face of said barrel, said first counterbore having a diameter substantially equal to a maximum diameter of a rifling of said muzzle loader barrel and being of a length sufficient to facilitate desired alignment of a slug, of a mating calibre, as a said slug is being inserted into said muzzle end of said barrel;

a second counterbore having a diameter that is larger than said diameter of said first counterbore, said second counterbore extending from said muzzle end face of said barrel to said first counterbore, and said second counterbore being dimensioned and being completely unobstructed so as to allow a slug loading tool to be inserted therein;

said first counterbore being completely unobstructed;

said rifling abutting said first counterbore being chamfered to facilitate insertion of a said slug from said first counterbore into said rifling of said barrel;

a chamfer is provided between said end face of said muzzle end and said second counterbore to facilitate insertion of a said loading tool into said muzzle end of said barrel; and said first counterbore having a length of from about 0.25 to about 1.75 inches.

2. The muzzle loader barrel according to claim 1 in combination with a gunstock and a trigger mechanism; and a portion of said barrel, remote from said muzzle end, is secured to said gunstock, and said trigger mechanism interacts with said breech end of said muzzle loader barrel for discharging of said rifled muzzle loader barrel as desired.

3. The combination according to claim 2, wherein openings are provided in said first counterbore of said barrel, said openings extending completely through a wall of said barrel along axes substantially perpendicular to a longitudinal axis of said barrel, said openings allowing gases, created upon discharge of a said slug from said barrel, to exit through said openings and create a force opposing a recoil force of said barrel.

4. The combination according to claim 3, wherein said openings comprise four spaced aligned holes located at 30° on each side of a vertical central plane defined by the longitudinal axis of said barrel and three spaced aligned holes located at 60° on each side of said central plane.

5. The combination according to claim 2, wherein a chamfer is provided between said first counterbore and said second counterbore to facilitate insertion of a said slug into said first counterbore.

6. The muzzle loader barrel according to claim 1, in combination with said slug loading tool for loading a muzzle loader barrel, wherein said slug loading tool comprising an elongated hollow body portion open at opposed first and second ends thereof and having outside dimensions sized to snugly slide into said second counterbore of said barrel, said body portion having an inside diameter sized to snugly accept a said slug, of said mating calibre for said barrel, therein and having a length such that a distance between a bottom of a said mating calibre slug, once said slug is provided therein, and said second open end of said body portion accommodates a desired measure of gunpowder; and a plunger member having an outer dimension having a sliding fit with the inside diameter of said body portion whereby with said body portion loaded with a said mating calibre slug and the desired measure of gunpowder, and when said second open end of said body portion is inserted into said second counterbore of said barrel, said plunger member is inserted into said first open end of said body portion, against said mating calibre slug, for pushing said slug and the desired measure of gunpowder into said barrel, following which said mating calibre slug is further insertable into said barrel by a ramrod.

7. A rifled muzzle loader barrel in combination with a slug loading tool for loading a muzzle loader barrel, said rifled muzzle loader barrel having a muzzle end with a first cylindrical counterbore therein, said first counterbore having a diameter substantially equal to a maximum diameter of a rifling of said muzzle loader barrel and being of a length sufficient to facilitate desired alignment of a slug, of a mating calibre, as a said slug is being inserted into said muzzle end of said barrel;

a cylindrical second counterbore being provided in said muzzle end between a muzzle end face of said barrel and said first counterbore, and said second counterbore being dimensioned to snugly receive a slug loading tool; and said slug loading tool comprising a cylindrical body portion open at opposed first and second ends thereof and having an outside diameter sized to snugly slide into said second counterbore of said barrel, said cylindrical body portion having an inside diameter sized to snugly accept a said slug, of said mating calibre for said barrel, therein and having a length at least substantially as long as a length of a said mating calibre slug whereby with said body portion loaded with at least a said mating calibre slug and when said second open end of said body portion is inserted into said second counterbore of said barrel, said mating calibre slug is insertable into said barrel when a plunger member is inserted in said first open end of said body portion.

8. The combination according to claim 7, wherein said rifling abutting said first counterbore is chamfered to facilitate insertion of a said slug from said first counterbore into said rifling of said barrel.

9. The combination according to claim 7, wherein a chamfer is provided between said end face of said muzzle end and said second counterbore to facilitate insertion of a said loading tool into said second counterbore.

10. The combination according to claim 7, wherein a chamfer is provided between said first and second counterbores to facilitate insertion of a said slug within said first counterbore.

11. The combination according to claim 10, wherein openings are provided in said first counterbore of said barrel, said openings extending completely through a wall of said barrel along axes substantially perpendicular to the longitudinal axis of said barrel, said openings allowing gases, created upon discharge of a said slug from said barrel, to exit through said openings and create a force opposing a recoil force of said barrel.

12. The combination according to claim 11, wherein said openings comprises four spaced aligned holes located at 30° on each side of a vertical central plane defined by the longitudinal axis of said barrel and three spaced aligned holes located at 60° on each side of said central plane.

13. The combination according to claim 7, wherein said first counterbore has a length of from about 0.25 to about 1.75 inches.

14. A rifled muzzle loader barrel in combination with a slug loading tool for loading said muzzle loader barrel, said rifled muzzle loader barrel having a muzzle end with a cylindrical first counterbore therein, said first counterbore having a diameter substantially equal to a maximum diameter of a rifling of said muzzle loader barrel and being of a length sufficient to facilitate desired alignment of a slug, of a mating calibre, as a said slug is being inserted into said muzzle end of said barrel;

a portion of said rifling abutting said first counterbore being chamfered to facilitate insertion of a said slug from said first counterbore into said rifling of said barrel;

a cylindrical second counterbore being provided in said muzzle end between a muzzle end face of said barrel and said first counterbore, and said second counterbore being dimensioned to snugly receive a slug loading tool; and said slug loading tool comprising a cylindrical body portion open at opposed first and second ends thereof and having an outside diameter sized to snugly slide into said second counterbore of said barrel, said cylindrical body portion having an inside diameter sized to snugly accept a said slug, of said mating calibre for said barrel, therein and having a length such that a distance between a bottom of a said mating calibre slug, once said slug is provided therein, and said second open end of said body portion accommodates a desired measure of gunpowder; and a plunger member having an outer dimension having a sliding fit with the inside diameter of said body portion whereby with said body portion loaded with a said mating calibre slug and the desired measure of gunpowder and when said second open end of said body portion is inserted into said second counterbore of said barrel and said plunger member is inserted into said first open end of said body portion against said mating calibre slug, said plunger member is used to push that said slug and the desired measure of gunpowder into said barrel, following which said mating calibre slug is further inserted into said barrel by a ramrod.

15. The combination according to claim 14, wherein a second chamfer is provided between said end face of said muzzle end and said second counterbore to facilitate insertion of a said loading tool into said muzzle end of said barrel.

16. The combination according to claim 14, wherein a chamfer is provided between said first and second counterbores to facilitate insertion of a said slug within said first counterbore.

17. The combination according to claim 14, wherein openings are provided in said first counterbore of said barrel, said openings extending completely through a wall of said barrel along axes substantially perpendicular to the longitudinal axis of said barrel, said openings allowing gases, created upon discharge of a slug from said barrel, to exit through said openings and create a force opposing a recoil force of said barrel.

18. The combination according to claim 17, wherein said openings comprises four spaced aligned holes located at 30° on each side of a vertical central plane defined by the longitudinal axis of said barrel and three spaced aligned holes located at 60° on each side of said central plane.

19. The combination according to claim 14, wherein said first counterbore has a length of from about 0.25 to about 1.75 inches.

* * * * *